United States Patent [19]

Walmsley et al.

[11] 4,251,046

[45] Feb. 17, 1981

[54] EXTENSIBLE BEAM ARRANGEMENT

[75] Inventors: Stanley Walmsley, Wigan; William R. Aldridge, Hindley, both of England

[73] Assignee: Coal Industry (Patents) Limited, London, England

[21] Appl. No.: 970,165

[22] Filed: Dec. 18, 1978

[30] Foreign Application Priority Data

Jan. 17, 1978 [GB] United Kingdom ..... 01739/78

[51] Int. Cl.[2] ..... F16M 13/00

[52] U.S. Cl. ..... 248/660; 173/38; 173/43

[58] Field of Search ..... 248/654, 651, 652, 653, 248/657, 662; 173/43, 38, 28, 45, 44

[56] References Cited

U.S. PATENT DOCUMENTS

| | | | |
|---|---|---|---|
| 3,150,723 | 9/1964 | Hale | 248/654 X |
| 3,162,253 | 12/1964 | Curtis | 173/43 X |
| 3,212,738 | 10/1965 | Curtis et al. | 248/654 |
| 3,356,163 | 12/1967 | Rowe et al. | 173/43 |
| 3,993,271 | 11/1976 | Kimber | 248/654 |
| 4,022,410 | 5/1977 | Einart | 248/652 X |

*Primary Examiner*—J. Franklin Foss

*Attorney, Agent, or Firm*—Stevens, Davis, Miller & Mosher

[57] ABSTRACT

Rock drilling equipment includes a boom carrying an extensible beam arrangement supporting a drilling mast, the extensible beam arrangement comprising a support pivotally mounted on the boom, a first elongated element slidably mounted on the support for movement longitudinally of the first element, a second elongated element slidably mounted on the first element for movement longitudinally of the first element, and drive transmission means sensitive to movement of the first element and adapted to move the second element relative to the support upon sensing relative movement between the support and first element.

6 Claims, 2 Drawing Figures

EXTENSIBLE BEAM ARRANGEMENT

This invention relates to extensible beam arrangements.

In particular, although not exclusively, the present invention relates to extensible beam arrangements for use with drilling and like equipment where typically the extensible beam arrangements support, for example, a drilling mast.

In the drilling of bore holes in a rock face to receive explosive charges for rock removal it is known to mount a drilling mast on a suitable carriage, such carriage being disposed adjacent the rock face to be drilled and the drilling mast being reciprocable relative to the carriage to and from an operative position.

One object of the present invention is to provide an extensible beam arrangement upon which at least one drilling mast is mounted and which is itself supported on the carriage, thereby to allow of the drilling of holes in rock faces in circumstances wherein the carriage cannot be moved close to the rock face in question.

According to the present invention, there is proposed an extensible beam arrangement comprising a support, a first element mounted on the support for movement relative thereto, a second element supported by and movable relative to the said first element, displacement means connected with and operable between the support and the first element and adapted, upon actuation, to effect a relative shift therebetween, and a drive transmission means connecting the support and said second element, the said drive transmission means being sensitive to relative movement between the support and the said first element and being adapted, upon such relative movement, to impart relative movement as between the first and second elements.

Preferably, the first and second elements are elongated elements and the movements are longitudinally of the elements.

According to a preferred feature, the drive transmission means comprises a pulley or the like on the first element and a draw cable or the like which, in use, is trained around the pulley, the ends of the said cable being connectable to the support and second element respectively.

According to a preferred feature, the drive transmission means is adapted to effect relative movement between the first and second elements for both directions of movement of the first element relative to the support.

Figure 1:
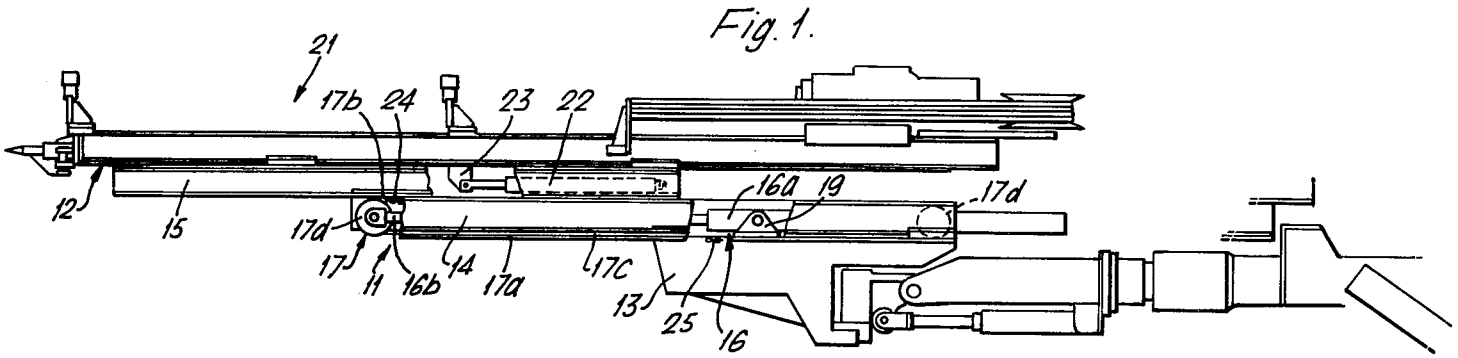
Figure 2:
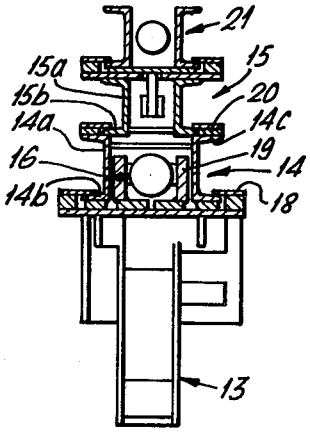

The invention will now be described further, by way of example only, with reference to the accompanying drawings illustrating one embodiment thereof and in which:

FIG. 1 is a side elevation of a first embodiment of the invention as applied to the support of a drilling mast as used in mine-workings; and FIG. 2 is a vertical section of the arrangement as shown in FIG. 1.

Referring now to the drawings, an extensible beam arrangement 11 for supporting a drilling mast 12 comprises a support platform 13 pivotally mounted on the forward end of a carriage (only a forwardly direct boom of which is shown in FIG. 1), a first elongated beam element 14 slidably mounted on the said support platform 13 for motion relative thereto in the longitudinal direction of such element, a second elongated beam element 15 slidably supported on the first such element 14, a displacement means 16 connecting the support platform and first beam element and adapted, upon actuation, to effect a relative shift therebetween, and a drive transmission means 17 connecting the second beam element 15 and the platform 13 and cooperable with the first beam element to impart an amplified motion to the second beam element relative to the first beam element upon motion of the latter relative to the support platform.

The support platform 13 consists of a generally horizontal support surface having an inwardly lipped guide means 18 at each longitudinal edge thereof, there being an upstanding trunnion 19 generally centrally of the support surface of a purpose hereafter to be made apparent.

The first beam element 14 comprises two channel members 14*a* arranged in outwardly facing, spaced disposition, the lower flanges 14*b* of the element being engaged with the guide means 18, thereby to locate such element transversely of the support platform. The upper face of the outwardly directed flanges 14*c* of channel members 14*a* carry inwardly lipped guide means 20.

The second beam element 15 likewise comprises two outwardly facing channel members 15*a* arranged in spaced parallel disposition, the lower flanges 15*b* of element 15 being slidably engaged with guide means 20 and being located in the transverse direction of element 14 by such guide means.

A drill mast 21 is slidably supported on the second beam element 15 in a manner analogous to the mounting of such element 15 on the first beam element, and is movable longitudinally of the second beam element by an hydraulic piston and cylinder arrangement 22 positioned within the second beam element 15 and operating between such element 15 and a lug 23 depending from the underside of the drill mast 21.

The displacement means 16 for effecting longitudinal shift of the first beam element 14 relative to the support platform comprises an hydraulic cylinder arrangement disposed within the first beam element 14, the cylinder 16*a* of such arrangement being pivotally mounted in trunnion 19 and the piston 16*b* being secured to the beam element 14 adjacent the forward end thereof. Upon actuation of the cylinder arrangement 16 the first beam member will be caused to move longitudinally of the guide means 18 provided on the support platform 13.

The drive transmission means 17 comprises a draw cable 17*a* (only one of which is shown) at each end of the first beam element, one end 17*b* of such cable being secured to the second beam element 15, as at 24, and the other end 17*c* being secured to the platform 13, as at 25, each such cable being trained around a roller or pulley 17*d* provided at each respective end of the first beam element.

As will be appreciated, actuation of the hydraulic cylinder in an appropriate sense will advance the first beam element relative to the support platform. Such relative movement will cause the cable at the forward end of the first beam element to move around the pulley at such end and will thus advance the second beam element relative to the first such element, the arrangement being such that the second beam element moves, relative to the first beam element, twice the distance moved by the first beam element relative to the support platform. Accordingly, there is a 3:1 amplification of the piston movement at the drilling mast.

By means of the arrangement as hereinproposed we are able to obtain an appreciable extension of the beam arrangement for only a limited stroke of the piston of the hydraulic cylinder, and, furthermore, are able to optimize on overall length of structure.

The invention is not limited to the exact features of the embodiment hereinbefore described, since alternatives will readily present themselves to one skilled in the art. Thus, while it is convenient to provide a draw cable at each end of the first beam element for co-operation with a related pulley, thereby to provide for movement of the second beam element for both directions of operation of the cylinder arrangement, a drive transmission means may, if desired, be provided at one end only, alternative provision being made for the return motion of the second beam element.

In addition to being of ready application in the context of the specific drilling machine shown in the drawings, the extensible beam is of use in other machines, such as, for example, that machine described and illustrated in the specification and drawings of the assignee's co-pending application Ser. No. 970,166 filed simultaneously herewith.

The invention is not limited to use in the context of drilling machines, since other analogous uses are possible.

We claim:

1. An extensible beam arrangement comprising a support, a first elongated element mounted on the support for movement relative thereto, a second elongated element supported by and movable relative to the said first element, displacement means connected with and operable between the support and the first element and adapted, upon actuation, to effect a relative shift therebetween, a drive transmission means connecting the support and said second element, the said drive transmission means being sensitive to relative movement between the support and the said first element and being adapted, upon such relative movement, to impart relative longitudinal movement as between the first and second elements, and a slide arrangement carried by the second element for movement relative to the second element under the action of further displacement means.

2. An arrangement as claimed in claim 1, in which the drive transmission means comprises a pulley or the like on the first element and a draw cable or the like which, in use, is trained around the pulley, the ends of the said cable being connected to the support and second element respectively.

3. An arrangement as claimed in claim 1, in which the drive transmission means is adapted to effect relative movement between the first and second elements for both directions of movement of the first element relative to the support.

4. An arrangement as claimed in claim 1, in which the support and first element define slideway means for the first element and second element respectively.

5. Drilling or like equipment including a drilling mast and an extensible beam arrangement comprising a support, a first elongated element mounted on the support for movement relative thereto, a second elongated element supported by and movable relative to the said first element, displacement means connected with and operable between the support and the first element and adapted, upon activation, to effect a relative shift therebetween, and a drive transmission means connecting the support and said second element, the said drive transmission means being sensitive to relative movement between the support and the said first element and being adapted, upon such relative movement, to impart relative longitudinal movement as between the first and second elements, and a slide arrangement carried by the second element for movement relative to the second element under the action of further displacement means.

6. Equipment as claimed in claim 5, in which the drilling mast comprising a drilling machine and a slide arrangement for the drilling machine.

* * * * *